US006059009A

United States Patent [19]

Haiber

[11] Patent Number: 6,059,009

[45] Date of Patent: May 9, 2000

[54] DEVICE AND TECHNIQUE TO HANG DECORATIVE OF FUNCTIONAL PANEL WITH GROMMETS

[76] Inventor: Gerd Haiber, Johanniterstr. 12, 72393 Burladingen, Germany

[21] Appl. No.: 09/195,698

[22] Filed: Nov. 19, 1998

[30] Foreign Application Priority Data

Nov. 20, 1997 [DE] Germany ..... 197 51 494

[51] Int. Cl.[7] ..... A47H 1/00

[52] U.S. Cl. ..... 160/330

[58] Field of Search ..... 160/330, 123, 160/126, DIG. 6, 405, 348, 340, 327, 354

[56] References Cited

U.S. PATENT DOCUMENTS

| | | | |
|---|---|---|---|
| 2,831,538 | 4/1958 | Lishman | 160/330 |
| 2,884,053 | 4/1959 | Truesdale | 160/330 |
| 4,188,991 | 2/1980 | Boyle | 160/330 X |
| 4,202,059 | 5/1980 | Faragher | 160/330 X |
| 5,111,868 | 5/1992 | Sawaya | 160/330 |
| 5,186,232 | 2/1993 | Zahner | 160/330 |
| 5,769,144 | 6/1998 | Carter | 160/330 |

*Primary Examiner*—David M. Purol

*Attorney, Agent, or Firm*—Griffin, Butler, Whisenhunt & Szipl, LLP

[57] ABSTRACT

A device and method for hanging decorative or functional panels with grommets involves prefabricated textile tape with built in grommets and a ring for covering each grommet for an aesthetic look and cost efficient fabrication. The tape with the grommets is sewn in its full width to a back of a panel. The panel is cut out within the grommet holes. A covering ring is put over the cut edge of the panel at each grommet and snapped into the grommet below. This prevents the edges of the panel from fraying and at the same time the grommets are fully covered. The tape is not visible from the front side. For decorative purposes, the rings can be made in different designs, colors and finishes and can be exchanged at any time.

7 Claims, 1 Drawing Sheet

DEVICE AND TECHNIQUE TO HANG DECORATIVE OF FUNCTIONAL PANEL WITH GROMMETS

BACKGROUND OF THE INVENTION

One popular style in interior design is to insert grommets in tops of decorative panels, such as drapes, curtains, room dividers or shower curtains and hang them by sliding support elements, such as drapery poles, rods or ropes, through the grommets. The grommets are usually made of metal with inside diameters thereof being larger than the diameters of the support elements, mostly ¾"–2". Feeding the support element, alternating from a front and from a back, through the grommets creates decorative folds in the panel. The panel can be moved back and forth on the support element and gathered in a bunch at one or both ends of the support element, for example at a side of a window or door opening.

Two conventional ways are known for attaching grommets to panels.

One uses an industrial tape with side by side grommets at preset spacings thereon. The tape is sewn to an upper edge of a panel, and becomes an extension of the panel, so that the panel stays below the grommets and leaves the grommets open for feeding the support elements therethrough. This construction leaves the tape with its raw, "technical" structure to be visible at the top of the panel. This look is rather unsightly, as the tape does not match the material, color and design, of most decorative panels.

Another method tries to overcome these disadvantages. In this method the grommets are punched directly into the panel either by hand or mechanically. However, this is time consuming and expensive, as this procedure requires several steps. The panel has to be doubled at the top by folding it over. Most often an additional stiffening material has to be sewn or fused in for stability and to prevent the panel material from fraying, being pulled out from the grommet or being cut at the edge of the grommet. This is especially true with thin delicate fabrics, which often require, with this method, additional protective washers. In accompanying steps, locations of the grommets have to be measured and marked over a whole width of the panel for even spacing and exact alignment. Then the grommets are punched in individually. When the grommets are hit to be punched, they often get scratches and dents, which diminishes their appearance. All these production steps, especially the manual ones, have to be performed with accuracy to justify the price of such an expensive product.

Both methods cannot avoid that the metal surfaces of the grommets scratch the surface of the support element, which can be a painted or polished drapery pole.

In shower curtains the plastic or plasticized material of the panels sometimes frays, very often being cut at, or ripped out of, the grommets.

The disadvantages mentioned above in the state of the art are eliminated by the present invention.

SUMMARY OF THE INVENTION

According to principles of this invention pre-manufactured textile tape having grommets therein, not visible from a front side of a panel, in conjunction with matching covering rings for the grommets, allows an evenly-spaced and precisely-aligned attachment of the grommets to a decorative or technical panel without an unfavorable look of the base metal grommets and the wear they cause in use.

The pre-manufactured tape of the invention has grommets of plastic or metal which are evenly spaced and precisely aligned along the textile tape. The tape is sewn with two (2) stitch lines to the upper edge of a backside of the panel, with one stitch line being above and one stitch line below the grommets, without doubling the panel at the top or adding a stiffener to it.

Using the pre-manufactured tape with integrated grommets as described above, it is no longer necessary to measure and mark locations of the grommets and to punch the grommets into the panel. The rather sturdy structure of the tape provides a desired stiffness to a heading of the panel without extra stiffeners and prevents the top edge above the grommets from sagging, when installed on a pole, rod or rope.

At this point the panel still covers all grommets and especially the holes through the grommets. They are cut out and opened manually with a cutting iron or punched out in a stamping machine. This is an easy task, as the grommets are firmly attached to the panel and act as a templet, which eliminates the necessity of measuring and marking the holes on the panel. Panel materials made of synthetic fibers can be heat cut with a shaped soldering iron, which gives the cut edges additional stability by fusing the cut fibers together.

Each of the covering rings of the invention covers an edge of the cut-out panel material at a grommet and squeezes it into a space between the covering ring and the respective grommet.

In a preferred embodiment of the invention, each covering ring, due to its construction, clamps firmly with snapping clamp protrusions and/or indentations to a respective grommet. With only mild pressing, it can be manually, without undue effort, automatically clamped, or clipped, to the grommet.

Also, according to a preferred embodiment, the panel, at the edges of the grommet holes, will be squeezed between grommets and the covering rings. This protects the edges and prevents fraying. It also stabilizes the edges of the cut-out holes and the part of the panel which lies between the two (2) stitch lines above and below a line of grommets, because the grommets, the covering ring and the panel are tightly connected to each other. The cut edges of the panel cannot be pulled from under the covering ring. Still further, a base of the ring facing the panel has teeth, spikes or grooves which add to the clamping effect by additionally pinning the panel down at the cutting edges.

The covering rings not only cover the edges of the holes in the panel material, they are made to fully cover inside diameters of the grommets as well.

Possible scratches and deformations of the grommets are hidden and the grommets themselves cannot diminish the appearance of the panel from the viewing side (front side). The covering rings can be made as design elements in decorative panels like drapes, curtains, room dividers or the like, using different colors, sizes, shapes and finishes. This feature is a further enhancement of this invention.

Covering the inside of the grommets with the covering ring has other merits when the ring is made of plastic. The grommets cannot scratch, scrape or damage the surface of decorative poles when the panel is moved back and forth. The covering ring is connected to the grommet by snapping it in from the front. The clamping parts of the ring are formed so that the clamping action is reversible. Pressing the ring from the back towards the front, it can be disengaged from the grommet and removed manually and without help. This allows one to change the rings in the panel for another look, or to take them off before washing or dry cleaning the panel. Other advantages and details of the invention are described in the preferred embodiment:

DETAILED DESCRIPTION OF THE INVENTION

Figure 1:
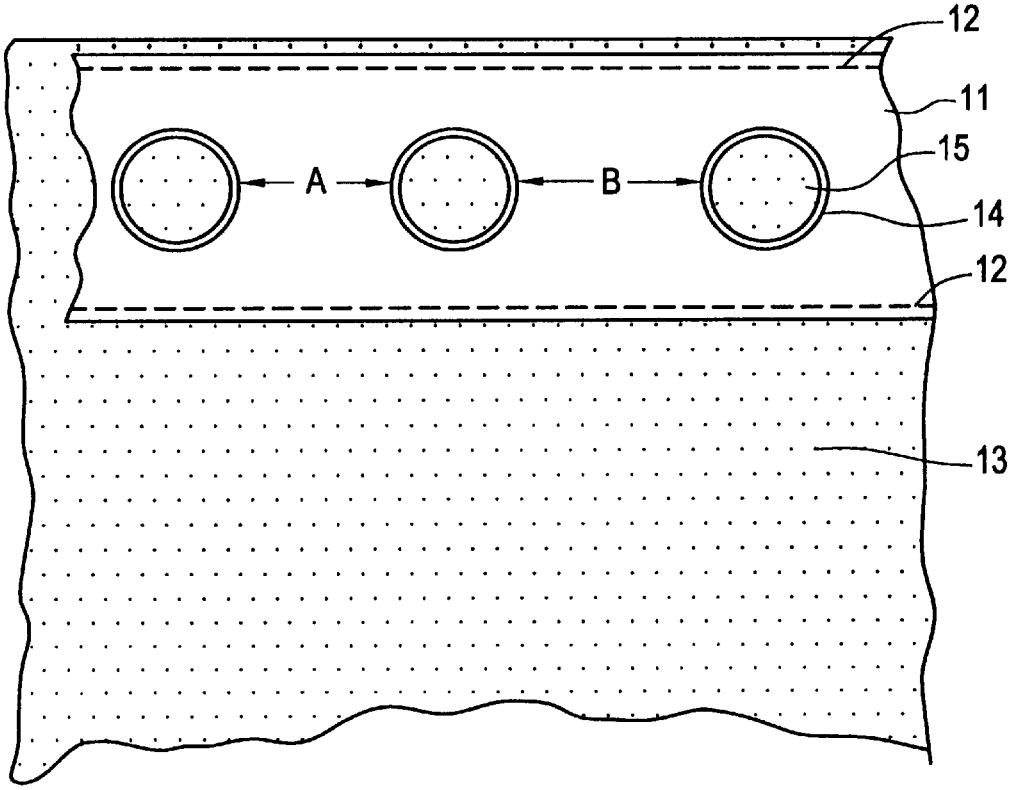
FIG. 1 is a side view, in reduced size, of a manufactured tape with grommets of this invention, sewn to a decorative textile panel, as seen from the backside of the panel.

FIG. 1 shows textile tape 11 sewn with two (2) stitchlines 12 full size to the back of a decorative panel 13. Metal grommets 14 are punched into the tape mechanically with exact spacing (A+B) and precisely lined up, using previously known fabrication methods.

Through an inside diameter of the grommet, the panel is still visible. This part 15 of the panel 13 has to be cut out with a cutting iron or a heated die, before a covering ring can be put on the grommet.

Figure 2:
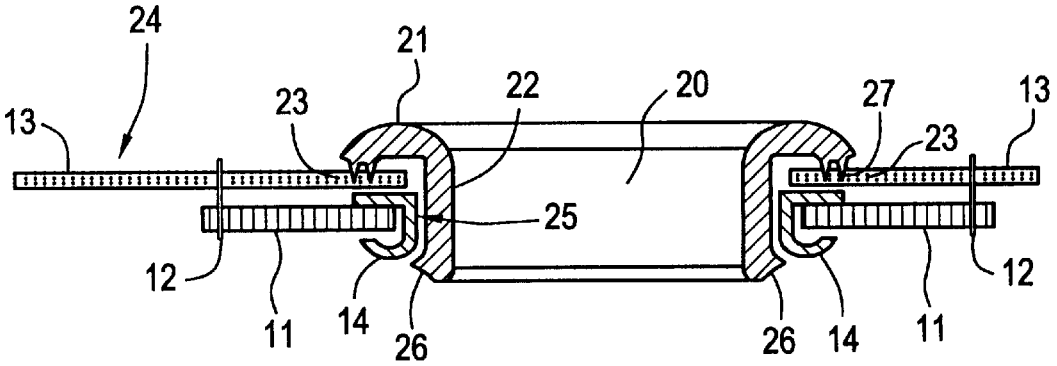
FIG. 2 is a cross-sectional view of a covering ring snapped into a grommet of FIG. 1.

FIG. 2 shows the preferred embodiment of the covering ring cut in half in cross section and snapped into a grommet from FIG. 1. The covering ring 20 includes an upper portion 21 which covers the grommet 14 and an edge of the panel material at a grommet hole 23 on a front side (viewing side) of the decorative panel. A center portion 22 is a neck which covers an inside of the grommet (arrow 25).

A lower portion of the covering ring 20 includes snapping clamp protrusions or indentations 26. After pressing the covering ring 20 from the front side to the grommet, the snapping clamp protrusions 26 snap in behind the grommet and connect the covering ring with a clamping effect to the grommet and the panel material. The size and configuration of the snapping clamp protrusions are made so that modest manual pressure without any help is enough to snap in and also, to be pressed out of the grommet from the backside.

The upper portion 21 of the covering ring 20 has built in spikes 27 which pinch into the panel material and keep it from moving. In this way it reinforces the clamping effect which holds the panel material steadfast between the covering ring 20 and grommet 14.

Drapes, curtains and other decorative or functional panels of the prior art are often installed by sliding a pole or rod through grommets, which are integrated in a heading (top edge) of a decorative or functional panel. To insert the grommets individually into the panel requires accuracy and several time-consuming production steps. They may even cause damage to the panel material.

Sewing a prefabricated tape with built-in grommets to a panel so that the tape extends along the top of the panel will show the raw texture and the different color of the tape, which makes the panel rather unsightly. Bare metal grommets as used in those methods can cause damage.

Instead this invention uses a prefabricated textile tape with built in grommets and rings covering the grommets for an aesthetic look and cost efficient fabrication. The tape with the grommets is sewn in its full width to the back of the panel. The panel is cut out within the grommet holes. The covering rings are put over the cut edges of the panel and snapped into the grommets below. This prevents the edges of the panel from fraying and at the same time the grommets are fully covered. The tape is not visible from the front side. For decorative purposes, the rings can be made in different designs, colors and finishes and can be exchanged at any time.

While the foregoing invention has been shown and described with reference to the preferred embodiment, it will be understood by those skilled in the art, that various changes in form and detail may be made therein without departing from the spirit and scope of the invention.

I claim:

1. A device for hanging decorative and functional panels, the device comprising:

a heading tape assembly comprising:

a prefabricated elongated textile tape, said tape having a plurality of aligned and pre-spaced tape holes along the length of said tape, with elongated edges of the tape extending along opposite sides of the tape holes so as to leave first and second attachment textile-tape edge portions on opposite sides of said aligned tape holes;

circular grommets, one mounted in each of said tape holes, each grommet being bent to be clamped to said textile tape for mounting it in its respective tape hole, each said grommet defining a grommet opening there-through;

a plurality of individual rings, each ring having a ring neck for being shoved through a grommet opening of one of said grommets from a front side of said tape toward a backside of said tape, each of said ring necks having a size and shape for tightly fitting the grommet opening for being automatically clamped to said grommet and for covering a portion of an inside diameter of the grommet, and each ring having a cover flange for covering a portion of a front side of the grommet panel;

whereby said device is suitable for hanging said decorative and functional panels by attaching said textile tape to said panel to be hung along two approximately-parallel attachment lines, one in each of said first and second textile-tape edge portions, with the front side of said tape lying against a back side of a panel to be hung, to thereby provide a pattern for cutting panel holes in said panel at said grommet holes and for then allowing said rings to be shoved through the panel holes and the grommet openings from a front side of said panel toward the backside of said tape so that said ring necks cover portions of edges of the panel material defining said tape holes and said cover flanges cover portions of said panel surrounding said panel holes.

2. The device as in claim 1, wherein the ring neck of each ring is sized and shaped to be attached to said grommet by spring snapping thereto so that it can be disengaged again without undue effort.

3. The device as in claim 1, wherein each ring is sized and shaped so the cover flange is adapted to squeeze the cut edge of the panel material with a clamping pressure between the covering flange and the grommet and this clamping pressure prevents the panel material from fraying or getting pulled.

4. The device as in claim 3, wherein said cover flange includes spikes for piercing said panel material.

5. The device as in claim 2, wherein the ring is of plastic.

6. The device as in claim 2, wherein the ring is of metal.

7. A method for hanging decorative and functional panels comprising:

sewing a premanufactured textile tape, having pre-spaced and aligned grommets thereon, to an upper edge of, and on a backside of, a panel to be hung, each of said grommets defining a grommet opening therethrough;

cutting the panel material covering each grommet opening to form a panel hole approximately concentric with said grommet opening;

extending a ring through each said panel hole and grommet opening from the front side of said panel, each said ring having a size and shape for tightly fitting said grommet opening for being automatically clamped thereto when pushed there into and for covering a cut edge of the panel material defining said panel hole and for covering said front side and inside of the grommet itself.

* * * * *